United States Patent [19]

Hughes et al.

[11] Patent Number: 4,966,230

[45] Date of Patent: Oct. 30, 1990

[54] SERPENTINE FIN, ROUND TUBE HEAT EXCHANGER

[75] Inventors: Gregory G. Hughes, Milwaukee; Scott Larrabee, Racine, both of Wis.

[73] Assignee: Modine Manufacturing Co., Racine, Wis.

[21] Appl. No.: 296,603

[22] Filed: Jan. 13, 1989

[51] Int. Cl.[5] ..... F28D 1/047

[52] U.S. Cl. ..... 165/150; 165/152; 165/153; 165/164

[58] Field of Search ..... 165/150, 152, 153, 170, 165/175, 164, 166

[56] References Cited

U.S. PATENT DOCUMENTS

| | | | |
|---|---|---|---|
| 2,057,298 | 10/1936 | Feldmeier | 165/170 X |
| 2,214,057 | 9/1940 | Hull | 165/152 X |
| 3,028,149 | 4/1962 | Pellmyr | 165/150 X |
| 3,147,800 | 9/1964 | Tadewald | 165/164 |
| 3,605,882 | 9/1971 | Smith et al. | 165/173 |
| 3,993,125 | 11/1976 | Rhodes | 165/153 |
| 4,332,293 | 6/1982 | Hiramatsu | 165/153 |

*Primary Examiner*—Martin P. Schwadron
*Assistant Examiner*—Allen J. Flanigan
*Attorney, Agent, or Firm*—Wood, Phillips, Mason, Recktenwald & VanSanten

[57] ABSTRACT

A highly efficient heat exchanger susceptible of a variety of uses is provided by a construction including first and second spaced, parallel headers 10, 12, 114 and 140 and a plurality of substantially identical serpentine conduits 18, 104 having at least three generally parallel runs 24, 105 and terminating in opposed ends 20, 22, 106, 108; 130, 132. The conduits 18, 104 are in generally spaced, side-by-side relation. One end 104 of each conduit 18, 104 extends to and is in fluid communication with the first header 10, 114, 140 and the other end of each conduit 18, 104 extends to and is in fluid communication with the second header 12. A plurality of serpentine fin sheets 30, 120 are located so as to extend between an associated pair of the conduits 18 in thermally conducive relation therewith.

16 Claims, 3 Drawing Sheets

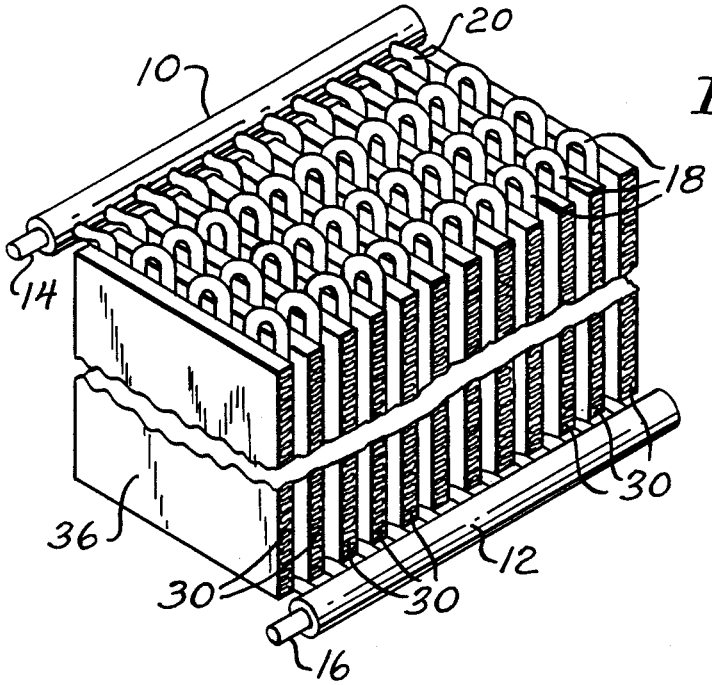
FIG. 1
FIG. 2
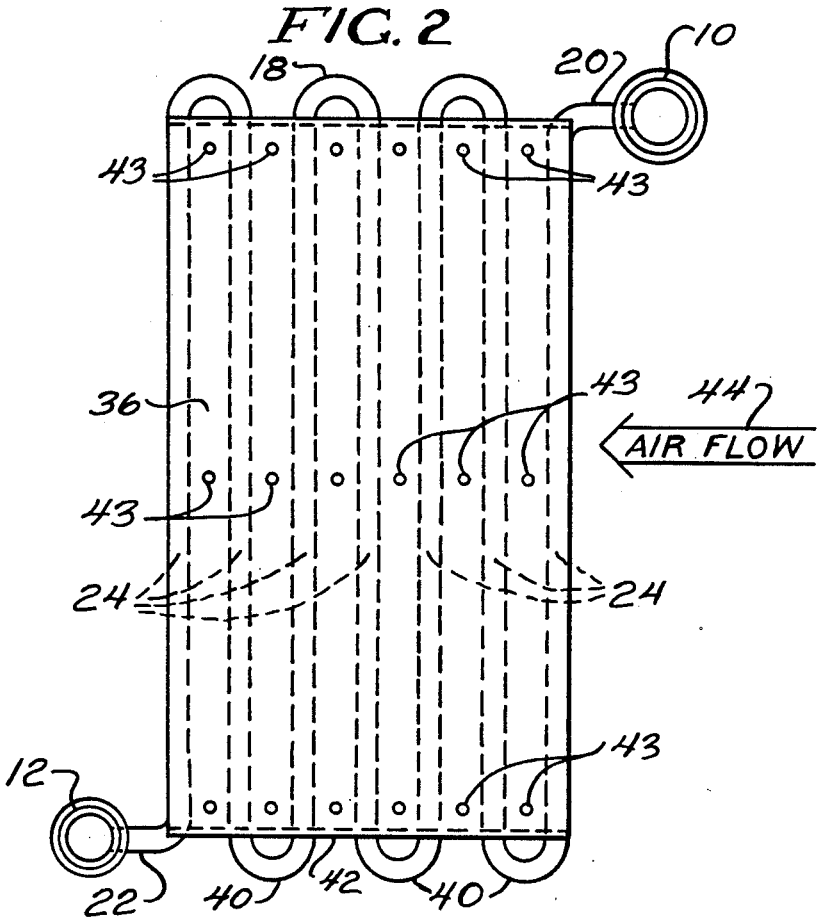

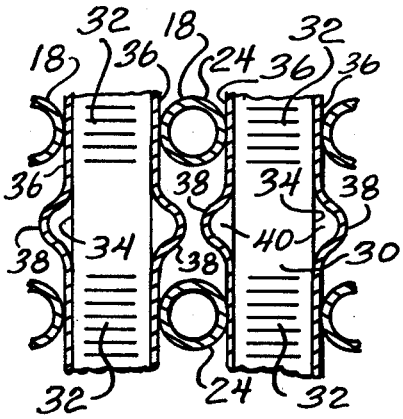
FIG. 5
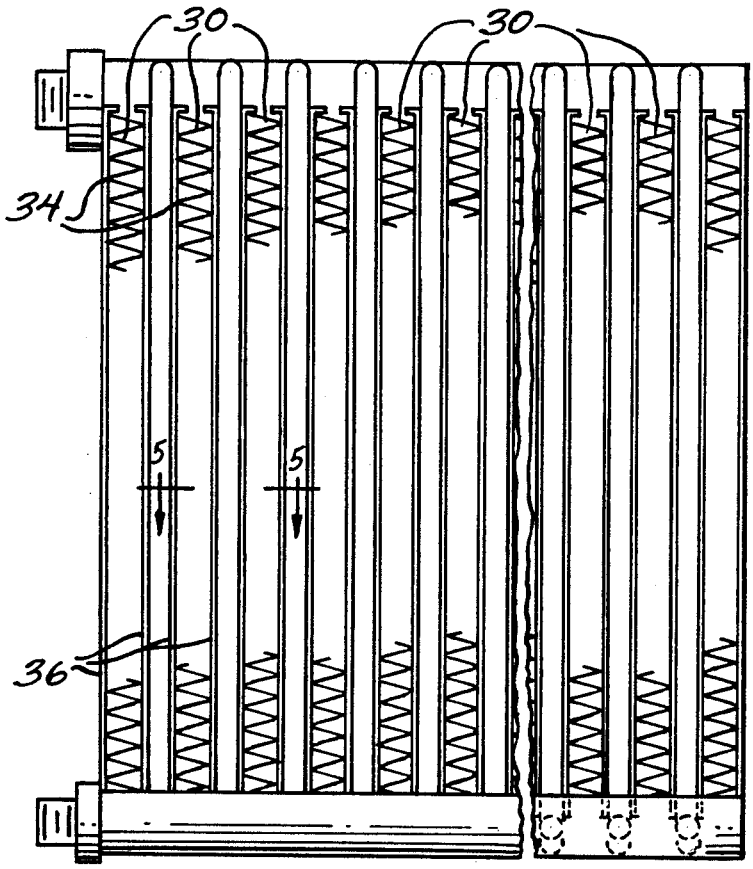
FIG. 3
FIG. 4
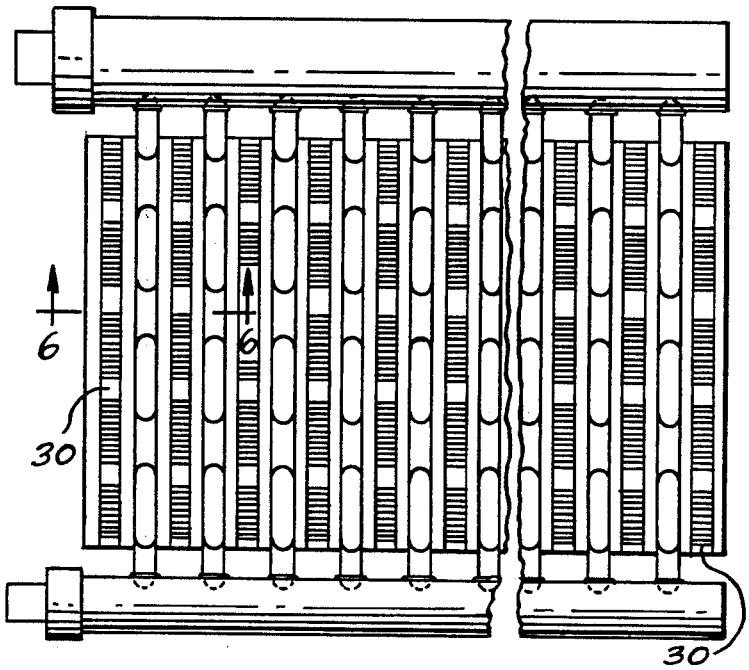
FIG. 6
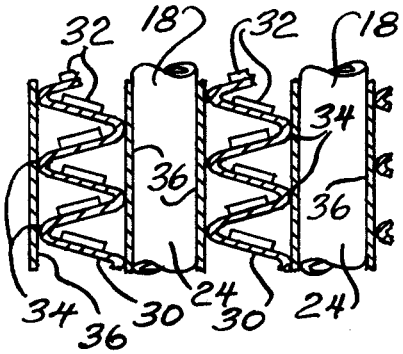

FIG. 7
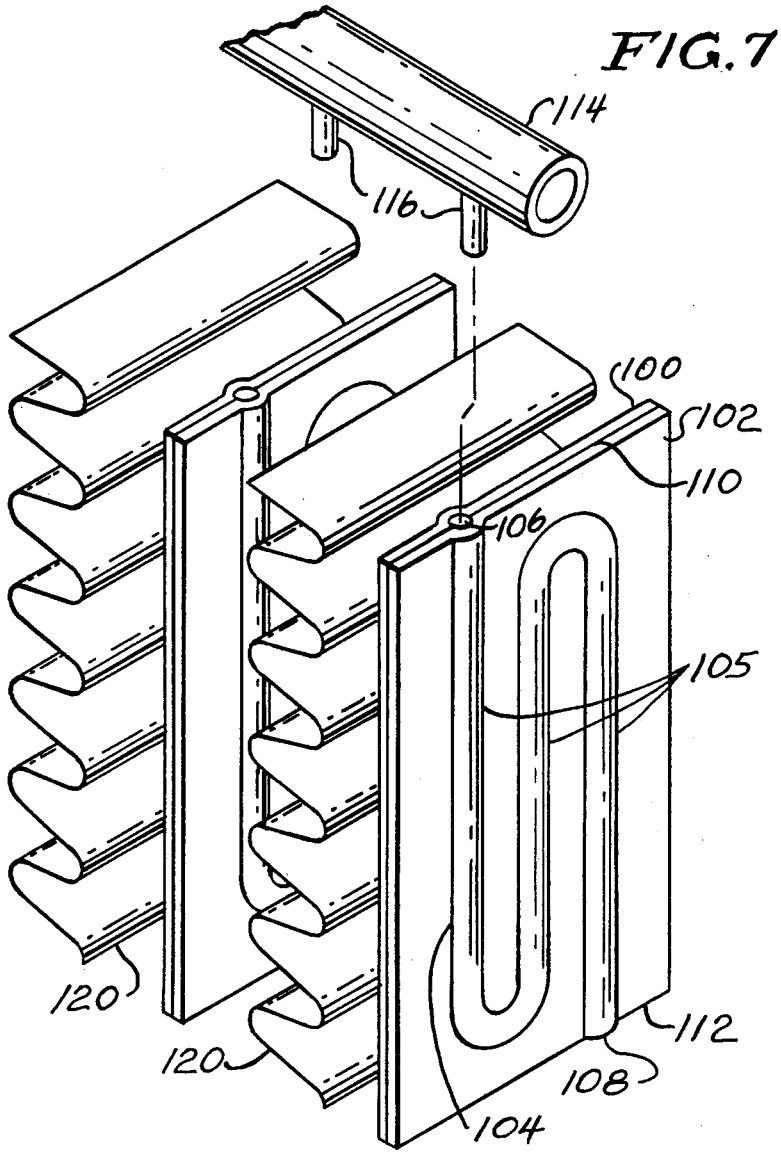
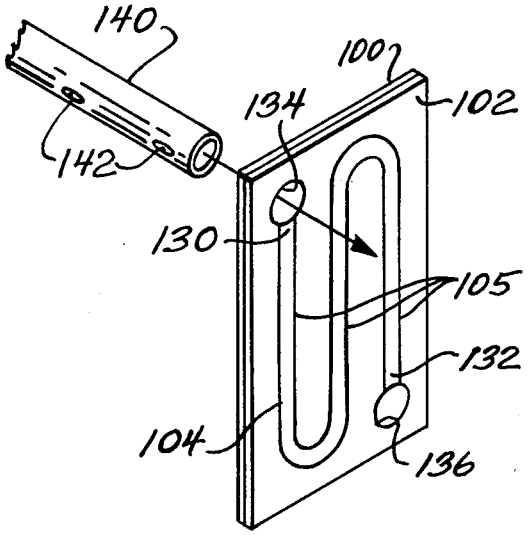
FIG. 8

SERPENTINE FIN, ROUND TUBE HEAT EXCHANGER

FIELD OF THE INVENTION

This invention relates to heat exchangers, and more specifically to a heat exchanger that employs round fluid passages (passages such as tubes and having circular cross sections) and serpentine fins, and which may be utilized as an evaporator, a condenser, an oil cooler, a vehicular radiator, or the like.

BACKGROUND OF THE INVENTION

The design of heat exchangers has often been dictated in part by various constraints imposed by the environment of intended operation. For example, heat exchanger constructions that are intended for use as condensers in refrigerant containing systems frequently are called upon to withstand much higher internal pressures than heat exchangers utilized for other purposes. This is due to the fact that condensers receive refrigerant vapor under relatively high pressure from a compressor or the like and must condense such vapor so that it may be recycled throughout the refrigerant containing system. Similarly, the area of a heat exchanger that receives one heat exchange fluid may be sized or shaped according to aerodynamic constraints where such a heat exchanger is to be employed as a vehicular radiator.

At the same time, heat exchange efficiency is always a concern. In this respect, it has been long recognized that where the two heat exchange fluids can flow in countercurrent relation, heat exchange is much more efficient as compared to systems employing concurrent flow or crosscurrent flow.

Again, however, design constraints may prevent one from taking advantage of countercurrent flow. A typical example of an application wherein countercurrent flow advantages may be unobtainable is in a radiator for a passenger car.

The invention seeks to overcome one or more of the above problems.

SUMMARY OF THE INVENTION

It is the principle object of the invention to provide a new and improved heat exchanger. More specifically, it is an object of the invention to provide such a heat exchange that is ideally suited for operation at elevated pressures, that may be easily constructed with any of a variety of facial areas or shapes to suit particular environmental conditions, and which has heat exchange efficiencies associated with countercurrent flow.

An exemplary embodiment of the invention achieves one or more of the foregoing objects in a structure including first and second spaced, parallel headers and a plurality of serpentine conduits each having at least three generally parallel runs and terminating in opposed ends. The conduits are in generally spaced, side-by-side relation and one end of each conduit extends to and is in fluid communication with the first header while the other end of each conduit extends to and is in fluid communication with the second header. A plurality of serpentine fin sheets are provided with each fin sheet extending between an associated pair of the conduits in thermally conductive relation therewith.

According to one embodiment of the invention, the conduits are tubes which are generally circular in cross-section thereby making the heat exchanger ideally suited for high pressure operations.

According to another embodiment of the invention, each such conduit is defined by a serpentine passage at the interface of an assembly of two plates bonded together.

According to this embodiment of the invention, passages may terminate at edges of the plate with the headers being located at such edges. Alternatively, a plurality of such assemblies may be placed in a side-by-side relation and include aligned apertures in fluid communication with the respective passages. According to this embodiment, the headers extend through the apertures in the plates.

The invention contemplates, according to one embodiment, that the serpentine conduits be substantially identical.

The invention further contemplates that the serpentine conduits be generally planar and that bonding sheets sandwich each of the conduits with the serpentine fin sheets being bonded to the adjacent bonding sheet on the associated conduits for high thermal effectiveness.

In a highly preferred embodiment, the serpentine fin sheets have a plurality of elongated crests and the crests are disposed to be generally transverse to the runs of the serpentine conduits.

When it is desired to use the heat exchanger as an evaporator, non-horizontal grooves may be provided in the bonding sheets and located between the runs of the serpentine tubes for channeling condensate. Alternatively, or in addition, holes or slots may be placed in the bonding sheets to encourage drainage of condensate.

In a highly preferred embodiment, the serpentine fin sheets are disposed to conduct fluid in a path that is at a substantial angle to the runs and there are more than three of such runs in each serpentine conduit so that the heat exchanger will perform in a fashion like a counterflow heat exchanger.

Preferably, the fin sheets, when measured along their crests, have a length on the order of the distance between the first and the last of the runs of the serpentine conduits.

The invention further contemplates that the headers have a circular cross-section.

Other objects and advantages will become apparent from the following specification taken in connection with the accompanied drawings.

DESCRIPTION OF THE DRAWINGS

FIG. 1 is a perspective view of a heat exchanger made according to the invention;

FIG. 2 is a side elevation of the heat exchanger;

FIG. 3 is a rear elevation of the heat exchanger;

FIG. 4 is a plan view of the heat exchanger;

FIG. 5 is a fragmentary, enlarged, sectional view taken approximately along the line 5—5 in FIG. 3;

FIG. 6 is an enlarged, fragmentary, vertical section taken approximately along the line 6—6 in FIG. 4.;

FIG. 7 is an exploded, perspective view of a modified embodiment of the invention; and FIG. 8 is an exploded, perspective view of still another embodiment of the invention.

DESCRIPTION OF THE PREFERRED EMBODIMENTS

An exemplary embodiment of a heat exchanger made according to the invention is illustrated in the drawing.

The actual embodiment illustrated in FIGS. 1–6 is specifically intended for use as an evaporator but it is to be understood that the invention may be advantageously employed as a condenser, an oil cooler, a radiator, etc. and may find utility in virtually any type of environment where one heat exchange fluid is a gas and the other is either a gas, a liquid or a mixture thereof. As seen in FIG. 1, the heat exchanger includes first and second, spaced headers or manifolds 10 and 12. The headers 10 and 12 are made up of tubes of circular cross-section and each includes a threaded fitting 14, 16 in fluid communication with its interior for connection into a fluid flow path. As illustrated, the headers 10 and 12 are at opposite corners of a rectangle but they could be on the same side if desired.

As seen in FIGS. 1 and 2, a plurality of serpentine tubes 18 are disposed in side-by-side relation. Preferably, each tube 18 is generally planar and has one end 20 mounted to and in fluid communication with the header 10 and an opposite end 22 mounted to and in fluid communication with the interior of the header 12.

In addition, each serpentine tube 18 is made up of a single length of tube which is to say that hairpins or elbows as may be conventionally used in plate fin type heat exchangers are not employed. Further, each of the serpentine tubes 18 has plural, generally parallel runs. Obviously, strict parallelism is not required and adjacent runs, opposite their connecting bend, can actually touch if desired to provide a more compact core and still be "generally parallel" as used herein. As seen in FIG. 2, these runs are designated 24 and seven such runs are employed. A greater or lesser number of runs may be utilized as desired but in every case, at least three of the runs 24 will be employed. Preferably, more than three runs 24 will be employed since that will result in the heat exchanger operating like a countercurrent flow heat exchanger.

As seen in FIG. 5, each of the serpentine tubes 18 is of generally circular cross-section. This allows a relatively high pressure fluid to be placed in the flow path including the headers 10, 12 and the tubes 18. Thus, the heat exchanger is ideally suited for use as a condenser. Again, a strict circular cross section is not required and in many instances the tubes 18 may be "spanked" slightly and yet retain the advantage of the ability to withstand high pressure.

In the space between each of the serpentine tubes 18, there is located a thin metal sheet deformed into the shape of serpentine fins 30 having louvers 32 therein. As can be appreciated from FIGS. 1 and 3, each of the serpentine fin sheets 30 extends virtually the entire length of each of the runs 24 from top to bottom. In addition, each sheet 30 has a length as measured along the crest 34 that is equal to the distance between the first and the last of the runs 24 of the tubes 18.

To assure a good assembly, generally planar bonding sheets 36 are employed. More specifically, each of the serpentine fin sheets 30 is sandwiched between two bonding sheets 36 and bonded thereto as, for example, by brazing or solder. As a result, the crests 34 of each of the serpentine fin sheets 30 are in good thermal conductive relation with the corresponding bonding sheets 36. The bonding sheets 36 are also similarly bonded to the sides of the run 24 of the tubes 18. Typically, the various bonds will be formed simultaneously as, for example, in a brazing oven.

Where it is desired to use the heat exchanger as an evaporator, the planes of the various bonding sheets 36 may be broken with vertically extending grooves 38 as best seen in FIG. 5. The grooves 38 extend inwardly through the space between adjacent runs 24 of a tube 18 and thus leave a gap 40 between the groove 38 and the crests 34. As a result, the grooves 34 channel condensate forming on the serpentine fin sheets 30 downwardly to a collection tray (not shown) or the like. Generally speaking, the grooves 38 will be located only between those runs 24 that are not connected at the bottom by a loop 40. However, where the tubing loops 40 extend below the lower edges 42 of the bonding sheets 36, thereby as shown in FIG. 2, and thereby provide a means by which condensate can exit from the space between the bonding sheets 36, the grooves 38 may be employed between all of the runs 24. Alternatively or in addition, small holes or slots 43 in the bonding sheets 36 and between the runs 24 may be used to provide a means by which condensate can exit or drain from the space between the bonding sheets 36.

As can be appreciated from a consideration of FIGS. 5 and 6, the crests 34 of the serpentine fin sheets 30 extend at right angles or transverse to the runs 24 of the tube 18. Thus, air flow in the direction of an arrow 44 (FIG. 2) will be flowing crosscurrent to the flow of fluid within the tubes 18. However, it has been determined that where the number of runs 24 exceeds four, the behavior of the heat exchanger will be like that of a countercurrent heat exchanger rather than a crosscurrent one as is actually the case. Thus, high efficiency is achieved.

In some instances, particularly where lower pressures are to be encountered during operation, the serpentine conduits employed by the invention may be formed by serpentine passages at the interface of an assembly of two plates bonded together rather than of the tubes 18. Such an embodiment of the invention is illustrated in FIGS. 7 and 8 wherein two plates 100 and 102, typically formed of aluminum or the like, are bonded together and, at their interface, include a serpentine passage 104 having at least three runs 105. The passage 104 has ends 106 and 108 terminating at opposite edges 110 and 112 of the assembly. A tubular header 114 provided with spaced nipples 116 located for entry into the openings 106 along with a similar header (not shown) for association with the ends 108 are provided. Serpentine fin sheets 120 are disposed between adjacent ones of the assemblies of the plates 100, 102 which are placed in side-by-side relation. If desired, bonding sheets may be employed as desired. Each of the assemblies may be formed utilizing known techniques common in the fabrication of evaporators for domestic refrigerators or by such other means as may be desired.

In the embodiment illustrated in FIG. 8, the serpentine passage 104 in each assembly terminates at opposed ends 130 and 132 located in apertures 134 and 136 respectively. The apertures 134 and 136 are in both of the plates 100 and 102 and are adapted to align with identical apertures when the assemblies are placed in side-by-side relationship such as illustrated in FIG. 7. A tubular header 140 having spaced ports 142 may be passed through the aligned apertures 134 such that each of the ports 142 is in fluid communication with an associated end 130 of the corresponding passage 104. A similar header is utilized in connection with the apertures 136.

From the foregoing, it will be appreciated that a number of advantages result. The structure allows the use of round aluminum tubes along with aluminum serpentine fins with a bonding sheet in between to assure good bonding and thus good thermal conductivity.

The crossflow design is such that, for a number of runs in excess of four, countercurrent flow type efficiency is achieved.

The use of the serpentine tubes 18 that join the headers 10 and 12 eliminate the hairpins or elbows that are required in conventional plate fin cores used in air conditioner applications.

Because of the disposition of the headers in the locations illustrated, the heat exchanger can be built with 100 percent heat exchange face area for receipt of a heat exchange fluid in the direction of an arrow 44 as illustrated in FIG. 2. There is no dead space due to tanks as a consequence.

Furthermore, the frontal configuration can be changed from the rectangular configuration illustrated to many different polygonal shapes to fit whatever space might be available simply by using non-identical serpentine tubes 18 wherein the lengths of the runs 24 vary from one tube 18 to the next and the top to bottom dimension of the serpentine fin sheets varied accordingly.

The heat exchanger provides for condensate drainage if used as an evaporator and additionally is such that it can withstand the highest possible burst pressures while being built with the thinnest stock possible through the use of tubes and manifolds or headers that are circular in cross-section.

The fact that the design provides a very high performance on the order of that of a countercurrent heat exchanger is an advantage.

In some instances, the size and shape of the manifolds may be different, one from the other. For example, when the heat exchanger illustrated in the drawings is utilized as an evaporator, a relatively small manifold 12 may be utilized to receive the liquid refrigerant while a relatively larger manifold 10 may be utilized as the vapor outlet.

The number of runs of the tubes can be easily altered to meet particular design requirements and the manifolds or headers may be located in virtually any desired position in relation to the core.

If desired, the tubes 18 may be dimpled externally to form dents inside of the tubes which will have the effect of increasing turbulation.

Thus, a highly advantageous construction results.

What is claimed:

1. A heat exchanger comprising:

first and second spaced parallel headers:

a plurality of substantially identical serpentine conduits having at least three generally parallel runs and terminating in opposed ends, said conduits being in generally spaced, side by side relation, one end of each conduit extending to and being in fluid communication with said first header and the other end of each of conduit extending to and being in fluid communication with said second header; and a plurality of serpentine fin sheets, each sheet extending between an associated pair of said conduits and in thermally conductive relation therewith;

said serpentine conduits being generally planar, and planar sheets sandwiching each of said conduits, said serpentine fin sheets being bonded to the adjacent planar sheet on the associated conduit pair.

2. The heat exchanger of claim 1 wherein the serpentine fin sheets have elongated crests and said crests are generally transverse to said runs.

3. The heat exchanger of claim 1 further including non-horizontal grooves in said planar sheets and located between said runs for channeling condensate when said heat exchanger is utilized as an evaporator.

4. The heat exchanger of claim 1 further including holes or slots in said planar sheets and located between said runs for water drainage when said heat exchanger is utilized as an evaporator.

5. The heat exchanger of claim 1 wherein said fin sheets are disposed to conduct a fluid in a path at a substantial angle to said runs and there are more than three said runs in each serpentine conduit so that said heat exchanger will perform like a countercurrent flow heat exchanger.

6. The heat exchanger of claim 1 wherein each of said fin sheets has a length on the same order as the distance between the first and last runs of each said serpentine conduit.

7. The heat exchanger of claim 1 wherein said conduits ar tubes.

8. The heat exchanger of claim 1 wherein each said conduit is defined by a serpentine passage at the interface of an assembly of two plates bonded together.

9. The heat exchanger of claim 8 wherein said passages terminate at edges of said plates and said headers are located at said edges.

10. A heat exchanger comprising:

first and second spaced parallel headers;

a plurality of planar serpentine conduits each having at least three generally parallel runs and terminating in opposed ends, said conduits being in generally spaced, side by side relation, one end of each conduit extending to and being in fluid communication with said first header and the other end of each of tube extending to and being in fluid communication said second header;

a plurality of serpentine fin sheets, each sheet extending between as associated pair of said conduits; and additional sheets sandwiching and bonded to each of said fin sheets and bonded to each said associated pair of said conduits on a side of each conduit thereof so that said conduits are in turn sandwiched by said additional sheets bonded thereto, and so that a said additional sheet is interposed between each said conduit and the adjacent if sheet.

11. The heat exchanger of claim 10 wherein said runs are vertically disposed and said additional sheets include groove formations between at least some of said runs.

12. The heat exchanger of claim 10 further including holes or slots in said additional sheets and located between said runs for water drainage when said heat exchanger is utilized as an evaporator.

13. A heat exchanger comprising:

first and second spaced parallel headers;

a plurality of planar serpentine conduits having at least three generally parallel runs and terminating in opposed ends, said conduits being in generally spaced, side by side relation, one end of each conduit extending to and being mounted in fluid communication with said first header and the other end of each of conduit extending to and being mounted in fluid communication said second header;

a plurality of louvered serpentine fin sheets, each sheet extending between an associated pair of said conduits and having generally parallel crests extending generally transverse to said runs; and additional sheets bonded to said crests and to respective sides of each said associated pair of said conduit so that a said additional sheet is interposed between each said conduit and the adjacent fin sheet.

14. The heat exchanger of claim 13 wherein said fin sheets, along said crests have a length on the order of the distance between the first and last of said runs.

15. The heat exchanger of claim 13 wherein said conduits are tubes having circular cross sections.

16. The heat exchanger of claim 15 wherein said headers have circular cross sections.

* * * * *